US005125461A

United States Patent [19]

Höser

[11] Patent Number: 5,125,461

[45] Date of Patent: Jun. 30, 1992

[54] POWER TOOL

[75] Inventor: Jürgen Höser, Neu-Ansbach, Fed. Rep. of Germany

[73] Assignee: Black & Decker, Inc., Newark, Del.

[21] Appl. No.: 689,444

[22] Filed: Apr. 22, 1991

[30] Foreign Application Priority Data

Apr. 27, 1990 [DE] Fed. Rep. of Germany ..... 4013512

[51] Int. Cl.[5] ..... B25D 11/10

[52] U.S. Cl. ..... 173/48; 173/109; 173/205

[58] Field of Search ..... 173/47, 48, 104, 105, 173/114, 117, 123, 109; 74/325

[56] References Cited

U.S. PATENT DOCUMENTS

| | | | |
|---|---|---|---|
| 3,334,694 | 8/1967 | Schnettler . | |
| 3,693,728 | 9/1972 | Stroezel | 173/48 |
| 3,794,124 | 2/1974 | Biersack . | |
| 3,799,275 | 3/1974 | Plattenhardt et al. | 173/48 |
| 3,828,863 | 8/1974 | Bleicher et al. . | |
| 3,828,865 | 8/1974 | Schnizler, Jr. . | |
| 3,955,628 | 5/1976 | Grözinger et al. | 173/48 |
| 4,418,766 | 12/1983 | Grossmann . | |
| 4,428,438 | 1/1984 | Holzer | 173/48 |
| 4,446,931 | 5/1984 | Bleicher et al. | 173/48 |
| 4,506,743 | 3/1985 | Grossmann . | |
| 4,732,218 | 3/1988 | Neumaier et al. . | |
| 4,763,733 | 8/1988 | Neumaier . | |
| 4,895,212 | 1/1990 | Wach | 173/48 |
| 4,998,588 | 3/1991 | Manschitz . | |

FOREIGN PATENT DOCUMENTS

| | | |
|---|---|---|
| 0331619 | 2/1989 | European Pat. Off. . |
| 1204126 | 12/1962 | Fed. Rep. of Germany . |
| 1957235 | 11/1969 | Fed. Rep. of Germany . |
| 2242944 | 8/1972 | Fed. Rep. of Germany . |
| 2323268 | 5/1973 | Fed. Rep. of Germany . |
| 3436220 | 10/1984 | Fed. Rep. of Germany . |
| 8436584 | 12/1984 | Fed. Rep. of Germany . |
| 3445577 | 6/1986 | Fed. Rep. of Germany . |
| 3732288 | 9/1987 | Fed. Rep. of Germany . |
| 3819125 | 6/1988 | Fed. Rep. of Germany . |

*Primary Examiner*—Frank T. Yost
*Assistant Examiner*—Scott A. Smith
*Attorney, Agent, or Firm*—Dennis A. Dearing; Charles E. Yocum; Edward D. C. Bartlett

[57] ABSTRACT

An electric power tool of the type which has an inserted tool bit (8), which can be operated with a rotary and a hammer action, and comprises a hammer which can be activated by axial displacement of the tool bit (8) by engagement with the work piece, also comprises a manually operable adjustment handle which can be rotated about an adjustment axis (59) between a first position in which a stop element (53) permits the axial displacement for the activation of the hammer means, and a second position in which the stop element (53) blocks the axial displacement. The stop element (53) is connected with cam surface (61, 62) which is coupled with an adjustment element (41) movement of which switches between high and low speeds of the tool. The cam surface has an arc-shaped portion (61) circular about the adjustment axis (59). Connected to one end of the arc-shaped portion(61) of the cam surface is a curved second portion (62), the distance of which from the adjustment axis (59) changes continuously. Through the engagement of the additional section (62) with the adjustment element (41), the adjustment element (41) is displaced on movement of the adjustment handle so to switch to another speed setting.

10 Claims, 12 Drawing Sheets

POWER TOOL

BACKGROUND OF THE INVENTION

The present invention relates to a power tool of the type which is adapated to hold an inserted tool bit which can be operated with a rotating action and a hammer action, hammer means of which tool can be activated by axial displacement due to the engagement of the inserted tool bit with the work piece to be worked upon. Such tools may comprise a manually operable adjustment handle which can be rotated about an adjustment axis between a first position in which a stop element permits axial displacement for the activation of the hammer means, and a second position in which the stop element blocks the axial displacement, and the invention relates to improvements in switching such a tool from one mode of the operation to another.

An electric power tool of this type in the form of a rotary hammer is described in European Patent No. 0 331 619. In this rotary hammer the adjustment handle has a rotary knob mounted in the casing wall, to which a pin which extends into the inner space of the casing is eccentrically connected, which in one position permits the axial displacement for the activation of the hammer mechanism so that the rotary hammer operates in the combined drilling and hammer mode, while in the other position, rotated about the adjustment axis opposite the first position, it lies against a disk which sits on the spindle of the rotary hammer and which can be moved together with the latter, and thus prevents the displacement of the spindle by the engagement of the inserted tool bit with the work piece and therefore prevents the activation of the hammer mechanism so that the rotary hammer operates in the pure drilling mode while the coupling for linking the hammer-mechanism to the rotary-driven intermediate shaft which rotatably drives the In this known electric power tool, it is therefore possible to switch between two modes of operation, namely combined drilling and hammering on the one hand, and pure drilling on the other. Frequently, however, it is also desirable to be able to switch into a further mode of operation, for example when in the pure drilling mode to switch from drilling at low speed to drilling at a higher speed. To achieve this in another known rotary hammer (German Patent Application P 34 45 577.9) two separate adjustment handles are provided, one to activate and deactivate the hammer mechanism, the other to enable switching between different speeds. In this arrangement with two adjustment handles each specific to different functions, in order to avoid switching to non-permitted combinations of operational modes, such as activation of the hammer mechanism at high speed, the adjustment handles are arranged directly beside one another with their grip sections constructed such that the adjustment handle for the hammer mechanism cannot be rotated into the position for the activation of the hammer mechanism when the adjustment handle for the speed is in the high-speed position. As a result, however, the construction is relatively complicated because not only are two separate adjustment handles required, but these must be provided in a quite specific way and in close spatial co-ordination on the electric power tool, which not only results in an expensive construction but also creates limitations as to the design of the interior structure of the electric power tool.

The object of the invention is to provide a power tool having a switching device with a simple construction which makes it possible to switch between at least three modes of operation without the risk of an incorrect combination.

SUMMARY OF THE INVENTION

The invention provides a power tool adapted to hold a tool bit which can be operated with a rotating action and a hammer action comprising drive means for causing the tool bit to rotate including a gear assembly which can be switched between a low gear drive and high gear drive, hammer means for imparting a hammer action to the tool bit and activated by axial displacement of the tool bit on engagement of said bit with a work piece, an adjustment handle connected to stop means and rotatable about an adjustment axis between a first position in which the stop means allows axial displacement of the tool bit, to activate the hammer means and a second position in which the stop means blocks axial displacement of the tool bit a cam member coupled to the adjustment handle and having an arcuate cam surface, said surface comprising a first, circular portion concentric with the adjustment axis and a second portion leading from one end of the first portion and continuously changing in distance from said axis, an adjustment element engaging the cam surface movement of which is arranged to switch said gear assembly between low gear and high gear drive, the arrangement being such that when the adjustment handle is in its first position the adjustment element is in engagement with one end of said first portion of the cam surface, when the adjustment handle is in its second position the adjustment element is in engagement with the other end of the first portion of the cam surface, with no movement of the adjustment element taking place as the adjustment handle is moved between its first and its second positions, and that the adjustment handle is movable into a third position beyond one of its first and second positions so that the adjustment element is in engagement with the second portion of the cam surface and the adjustment element is displaced to cause the gear assembly to change between a low gear and a high gear drive.

A power tool according to the invention therefore has only one adjustment handle, which can be brought into three positions, which when switching from the first to the second position brings the stop means into a different functional position, while the first portion of the cam surface, which is provided on the stop means or is connected therewith, due to its circular arc-shaped construction lying concentric in relation to the adjustment axis does not displace the adjustment element coupled with the cam surface. It is only when the adjustment handle is displaced from beyond the first or second positions to the third position that the second portion of the cam surface, due to its changing distance from the adjustment axis, brings about a displacement of the adjustment element and therefore a switching over from one speed of the gear assembly to another speed, e.g. from a low speed to a high speed. Preferably the second portion of the cam surface leading from the first portion is continuously increasing in distance from the adjustment axis.

Since the switching between activated and deactivated hammer means and between different speeds of the gear assembly is carried out using only one adjustment handle, there is no risk of having an incorrect combination of modes of opeation. Instead, such incorrect combinations are completely excluded by the construction of the switching device. Moreover, a more simple construction results, in particular because the position of the single adjustment handle on the casing of the tool can be chosen to correspond to the optimum requirements of the interior structure of the tool.

The cam surface and the adjustment element preferably engage in positive manner with each other, so that the first portion of the cam surface holds the adjustment element in position, while the engagement of the second portion of the cam surface with the adjustment element, on appropriate movement of the cam surface, effects a displacement, brought about by the second portion, of the adjustment element in one or the other direction, without the movement and/or the positioning of the adjustment element having to be supported by springs. To effect this positive engagement the cam surface may be provided by a curved web and the adjustment element can have a receiving slot, open in a direction parallel to the adjustment axis, for the web-shaped cam surface such that the side walls of the receiving slot engage opposite surfaces of both sides of the web.

Stops can be provided next to the ends of the cam surface to limit its rotational movement.

The stop means to be used in a tool according to the invention can have a circular arc-shaped stop face concentric to the adjustment axis, which stop-face in at least one position of the adjustment handle prevents the axial displacement of the tool which activates the hammer mechanism.

The adjustment element can be engaged with an axially displaceable gear wheel of the gear assembly, and therefore can directly alter the position of this gear wheel when the adjustment element is displaced by movement of the adjustment handle. For this purpose the adjustment element can be axially displaceable mounted on a guide-rod extending parallel to the central axis of the gear wheel.

In one embodiment of the invention, the second portion joins on to the second end of the first portion of the cam surface, and the adjustment element, in the third position of the adjustment handle, brings about a higher speed of the tool holder for the inserted tool bit than in the first and second position.

In such an embodiment, therefore, in the first position of the adjustment handle the hammer mechanism can be activated by axial displacement, and the gear assembly is at a pre-determined speed setting, normally a setting for low speed. When the adjustment handle is moved into the second position, without changing the position at the elements of the gear assembly, the stop element is moved into a position in which it prevents axial displacement for the activation of the hammer mechanism, i.e. the inserted tool bit is driven in rotation only and at the speed determined by the setting of the gear arrangement.

If the adjustment handle is then displaced beyond the second position into the third position, the adjustment element is moved by the shape of the additional section of the cam surface and as a result another speed setting of the gear assembly, for example a higher speed, is selected.

In this construction, in the third position of the adjustment handle the stop means can block axial displacement for the activation of the hammer mechanism so that it is only possible to drive the inserted tool bit in rotation, e.g. at a high speed; such a high speed would not be appropriate if the hammer mechanism were activated because this would damage the tool.

In another embodiment of the invention, the second portion of the cam surface joins on the first end of the first portion of the cam surface and the adjustment element, when the adjustment handle is in the third position, renders the rotational drive of the tool holder for the inserted tool bit ineffective.

Thus in this embodiment, if the adjustment handle is moved beyond the first position into the third position, then a switching occurs from a speed at which the tool operates optionally with or without activation of the hammer mechanism to a speed of zero, i.e. the tool operates in pure hammer mode.

To ensure this interruption of the rotary drive, the gear assembly engaged with the adjustment element can, when the adjustment handle is in the third position, be engaged with a locking element which prevents rotational movement; the locking element can, for example, be a stationary mounted locking pin, which in the third position of the adjustment handle is engaged with a recess of the gear assembly.

BRIEF DESCRIPTION OF THE DRAWINGS

The invention is described in more detail in the following with reference to the drawings

DETAILED DESCRIPTION

Figure 1:
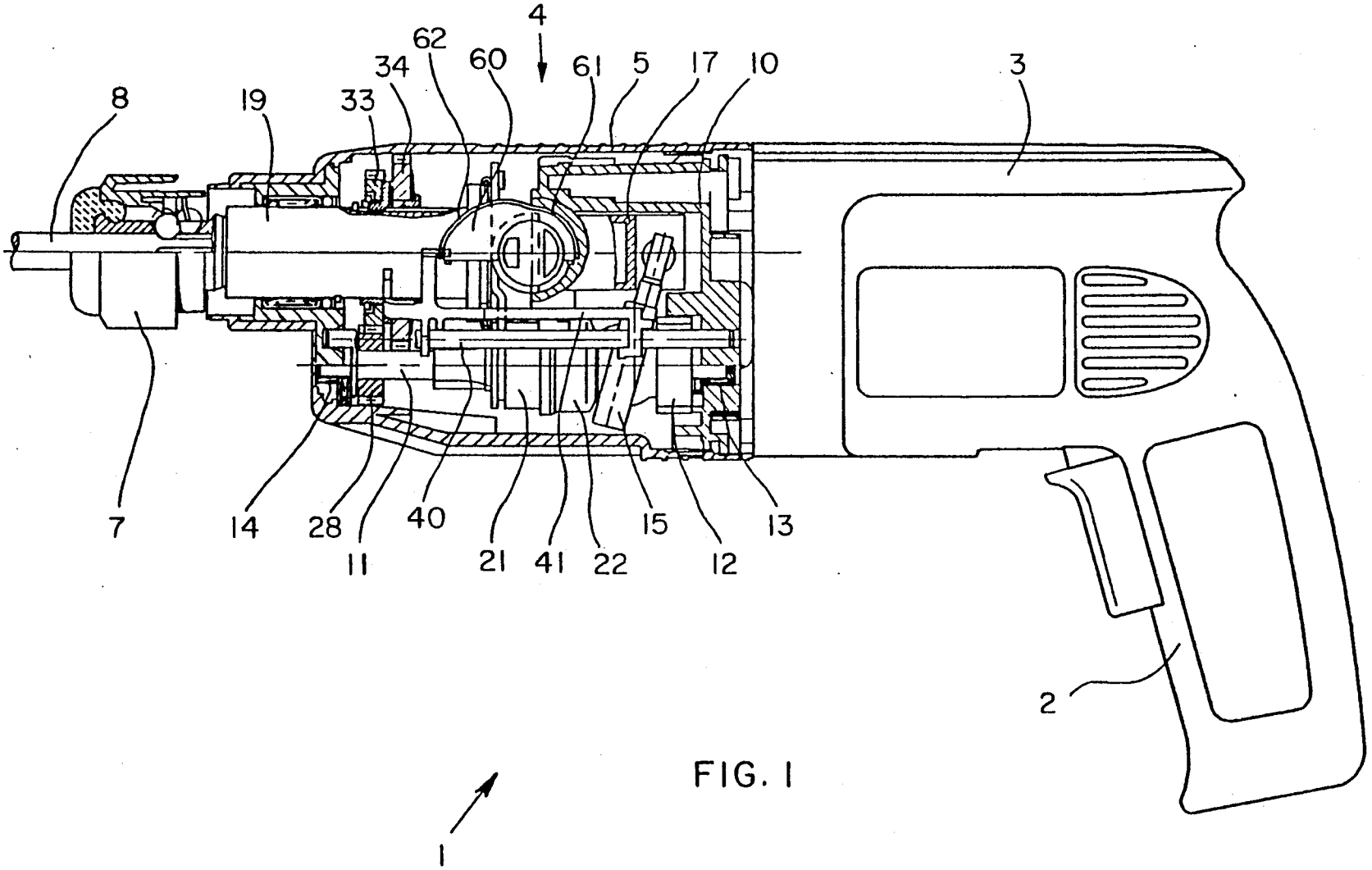
FIG. 1 shows a power tool in the form of an electric rotary hammer partly as a side view and partly cut away.

FIG. 1 shows a rotary hammer, that is a power tool adapted to hold a tool bit which can be operated with a rotating action and a hammer action.

The rotary hammer 1 has a casing consisting of two casing halves 5 and 6 which forms a gear housing 4, which is shown opened and partly in section in FIG. 1, a motor housing 3 lying behind the gear housing 4 and a handle 2 connected to the motor housing 3. A trigger element for an on/off switch of the rotary hammer 1 projects from the handle 2 in the usual way, while the power cable which likewise usually leads into the handle is not shown. At the front end of the rotary hammer 1 a tool holder 7 of the usual construction is provided which is connected with a spindle 19 of the rotary hammer and into which is inserted a tool bit in the form of a partly shown hammer bit 8.

Figure 2:
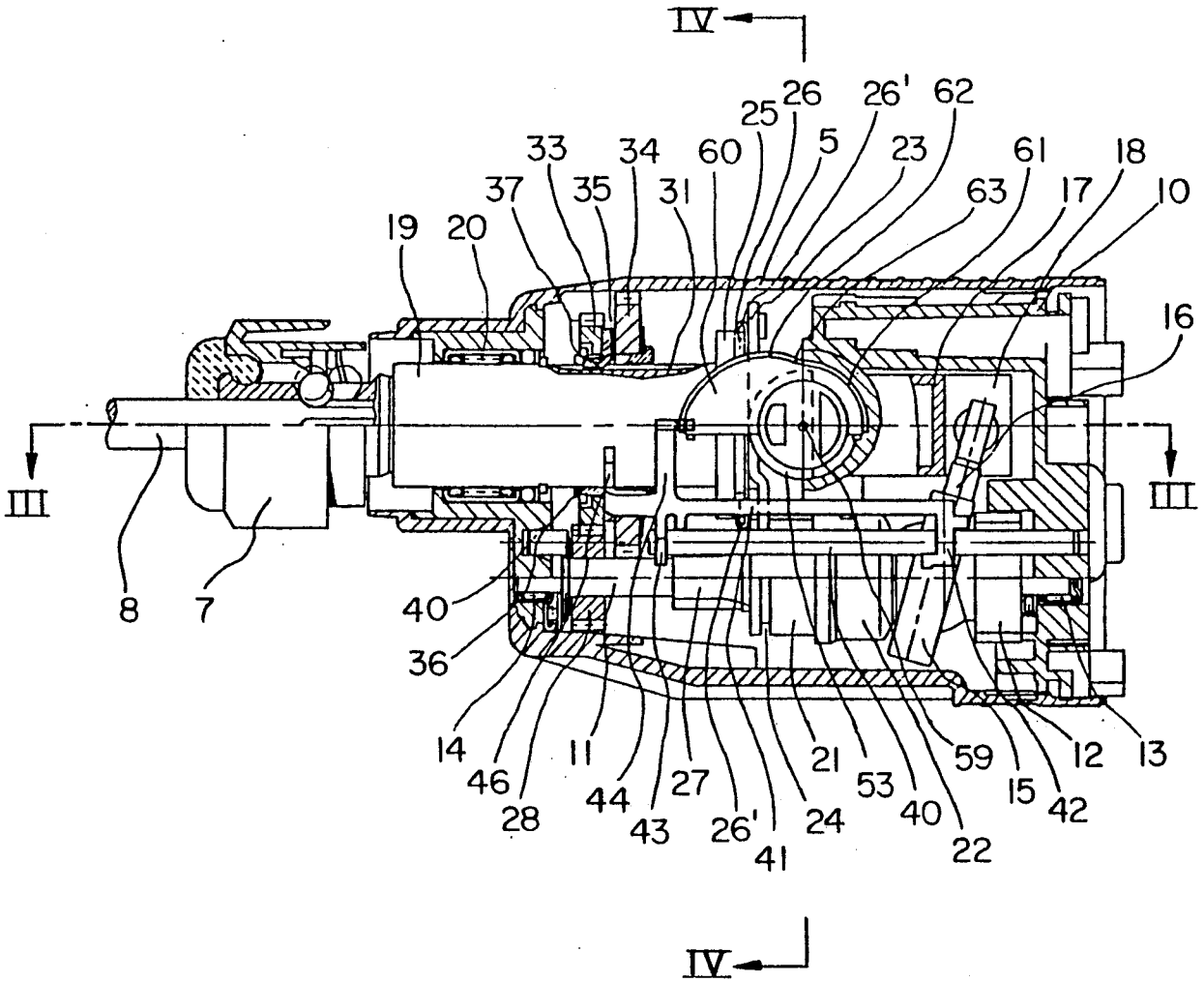
FIG. 2 shows an enlargement of the front section of the rotary hammer from FIG. 1, partly cut away and partly as side view.

As can be seen most clearly from FIG. 2, in the area of the gear housing 4 of the rotary hammer 1 a bearing part 10 is provided, which usually consists of metal and performs numerous bearing functions. For example, a rear end portion of an intermediate shaft 11 is housed in the bearing part 10 by means of a bearing 13, a front end portion of which intermediate shaft sits in a bearing 14. On the rear end portion of the intermediate shaft 11 a gear wheel 12 is non-rotatably fixed, which meshes with a pinion of an armature shaft, of an electric motor (not shown) fixed in the motor housing 3, so that the intermediate shaft 11 is driven in rotation by the said motor.

On the intermediate shaft 11 a coupling with two coupling halves 21, 22 is seated, by means of which a wobble plate element 15, can be driven. A pin 16 of the wobble plate element 15 is engaged with a rear end portion 18 of a reciprocating hollow piston 17, in which a ram (not shown) is reciprocated by the formation of under-pressure and over-pressure when the hollow piston 17 is reciprocated. For the construction of the coupling and the way it functions and the way the hollow piston which forms part of the hammer mechanism functions, including the way it is driven by the wobble plate element, reference is made to European Patent No. 0 331 619, which also describes the manner in which engagement of the coupling halves 21, 22 is effected through the axial displacement of the spindle 19 held in a bearing 20 by means of a sliding unit, comprising a sliding element 23, a bearing 26 and a disk 25, and by means of the engagement of the sliding element 23 with an annular slot 24 in the coupling half 21 when the axial displacement movmeent of the spindle 19 is not blocked by the operator.

A gear wheel 28 is fixed to a front end portion of the intermediate shaft 11 and meshes in the position in FIG. 2 with a gear wheel 33. The gear wheel 33 belongs to a gear assembly, which comprises a bush 36 which carries, non-rotatably, the gear wheel 33 and next to it a gear wheel 34 of a greater diameter which is mounted on the spindle 19 so as to be axially displaceable to a limited extent. Through a wall of the bush 36 a key-like projection 37 extends which is engaged with an axial groove 31 in the surface of the spindle 19, so that the bush 36 is held non-rotatably on the spindle 19.

Due th the axial displaceability of the bush 36, the gear assembly can be shifted to the right in a manner yet to be described from the position shown in FIG. 2, and as a result the gear wheel 33 engages from the gear wheel 28 on the intermediate shaft 11, but the gear wheel 34, fixed to the bush 36, comes into meshing engagement with a gear wheel section 27 of the intermediate shaft 11. In this position, due to the changed transmission ratio, a lower speed of the spindle 19 results, i.e. the gear assembly is in a position which can be called the first gear while the position as in FIG. 2 is called the second gear.

Figure 3:
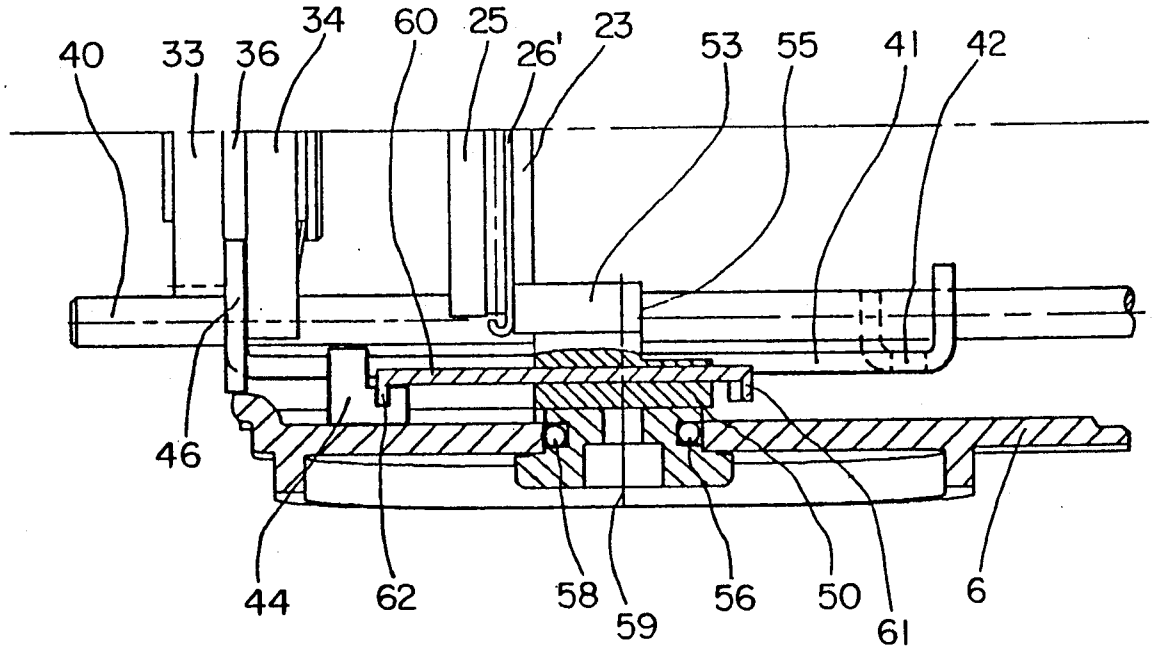
FIG. 3 shows the structure of a switching device of the rotary hammer is a part section along the line III—III of FIG. 2.
Figure 4:
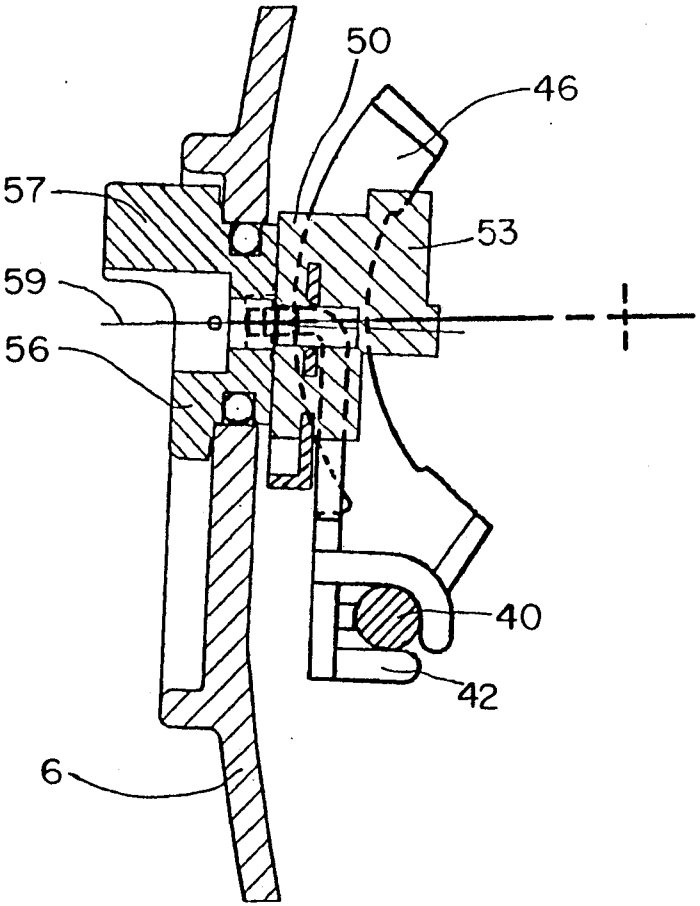
FIG. 4 shows the switching device in vertical partial section along the line IV—IV of FIG. 2.

An adjustment handle (FIG. 3) comprising a cylindrical portion 56 and a grip portion 57 is rotatably mounted in an opening in the casing half 6. An O-ring 58 is mounted in an annular groove in the cylindrical portion 56. The handle can be rotated about a central axis 59. ("the adjustment axis").

Concentrically fixed to the cylindrical portion 56 is a boss 50 comprising recesses 51, 52 formed in its surface facing the cylindrical portion 56 of the adjustment handle; corresponding projections of the cylindrical portion 56 extend into these recesses which, together with a screw inserted along the adjustment axis 59, produce a non rotatable connection between the cylindrical portion 56 and the boss 50.

A stop element 53 is formed on the side of the boss 50 facing away from the cylindrical portion 56. The stop element 53 essentially consists of an approximately semicircular arc-shaped disk, having a circular peripheral surface 55 formed about the adjustment axis 59 and a flat peripheral surface 54, connecting the ends of the circular surface 55, parallel to a diameter passing through the adjustment axis 59, and lying on the opposite side of the axis 59 from the circular surface 55, i.e. the circular surface 55 extends over more than a semi circular.

Fixed to an intermediate portion of the stop element 53 is a cam member 60, on the edge of which a cam surface 61, 62 is formed. A first portion 61 of this cam surface is in the form of a circular arc about the axis 59 and extends over about 90°. The first, free, end of the portion 61 lies slightly above a diameter extending through the axis 59 and perpendicular to the flat surface 54 of the stop element 53. A second portion 62 of the cam surface joins on to the second opposite end 63 of the first portion 61 and likewise extends over about 90°, its distance from the axis 59 gradually increasing from the second end 63 of the portion 61 to the free end of the portion 62. First portion 61 and the second portion 62 provide a web or flange which projects from the edge of the cam element 160 in the direction of the cylindrical portion 56 of the adjustment handle. Adjacent to the free ends of the first portion 61 and second portion 62, stops 64, 65 are formed on cam element 60, projecting in a corresponding manner in the form of ribs and serving to limit rotational movement.

Figure 5:
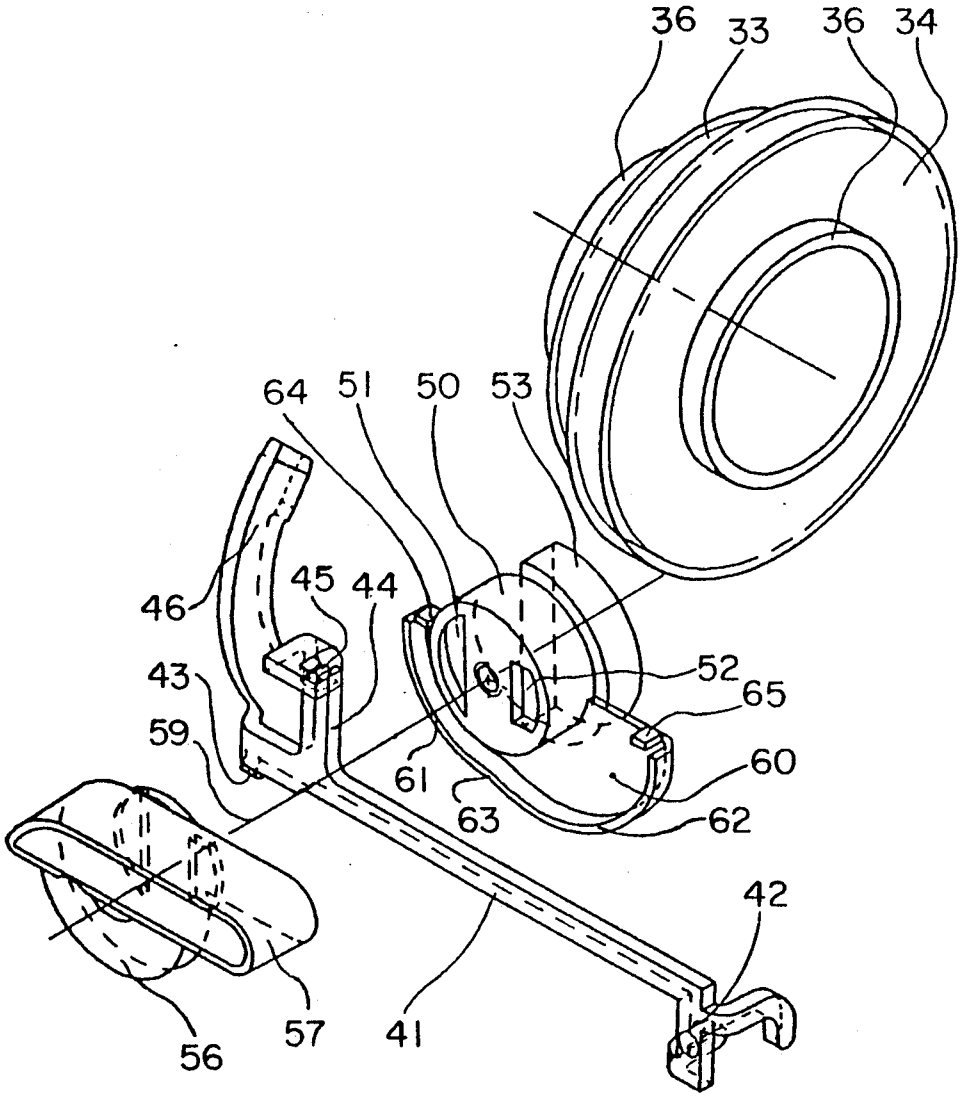
FIG. 5 shows in an exploded view parts of the switching device and also a gear assembly which engages with an adjustment element of the switching device.

A rear end of a guide rod 40 is mounted in bearing part 10, the rod extending forward parallel to the intermediate shaft 11 and to the spindle 19 and having its front end mounted adjacent to the intermediate shaft 11. On the guide rod 40 there is mounted an oblong adjustment element 41, (FIG. 5) which has a rear bearing section 42 and a front bearing section 43 and can be slid along the guide rod 40. On the adjustment element 41, at about the area of the bearing section 43, a guide arm 44 is formed which has a slot 45 in its upper angled end. The adjustment element 41 is arranged so that the slot 45 grips over the free edge of the first portion 61 and second portion 62 of the cam surface, so that the web or flange forming the portion 61 and the additional portion 62 is situated between side walls of the slot 45.

At the end of the adjustment element 41 next to the guide arm 44 a curved carrier arm 46 is provided which extends into an annular indent 35 between the two gear wheels 33 and 34 fixed on the bush 36. This carrier arm 46 is curved slightly and thus its shape matches the shape of the indent 35.

Figure 6:
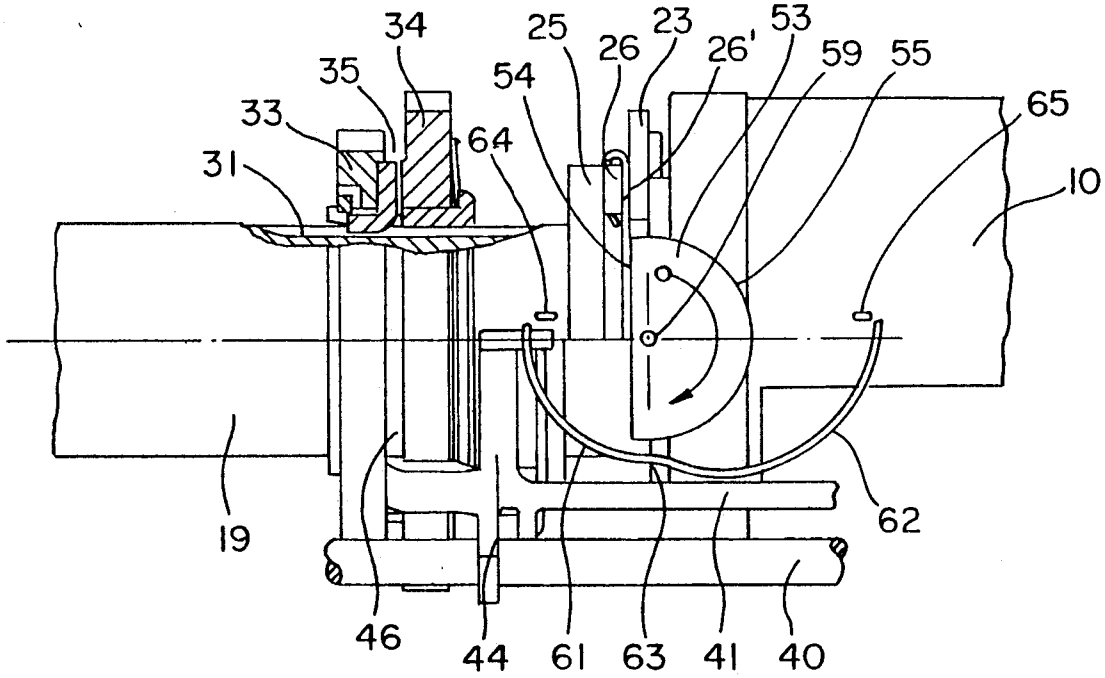
FIG. 6 shows a diagrammatic representation of the switching device of the rotary hammer of FIGS. 1 to 5 when the adjustment handle is in a first position.
Figure 7:
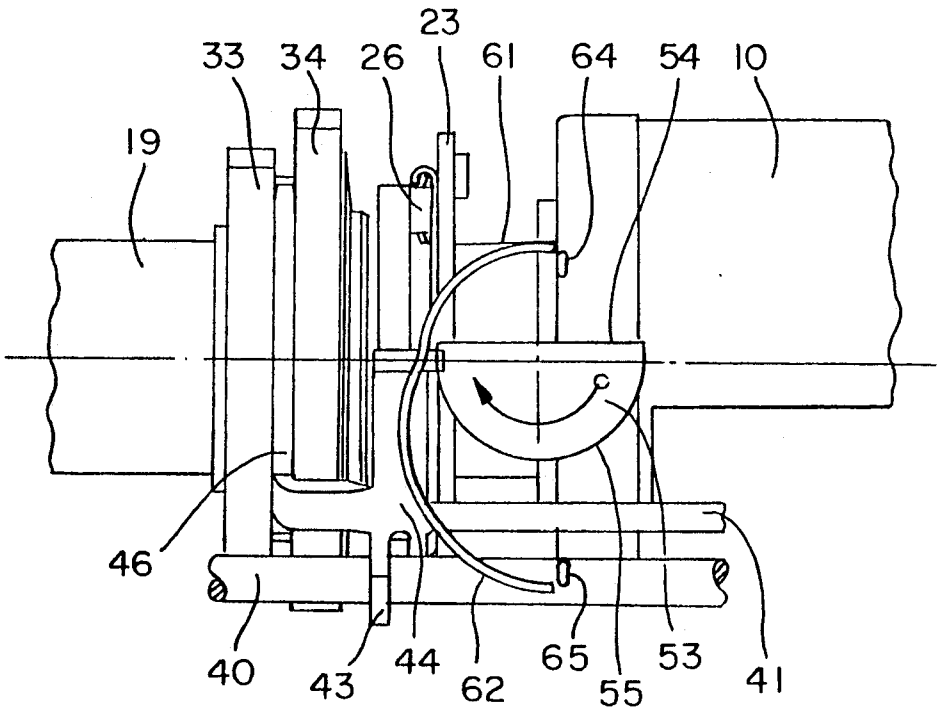
FIG. 7 shows a representation corresponding to FIG. 6 when the adjustment handle is in a second position.
Figure 8:
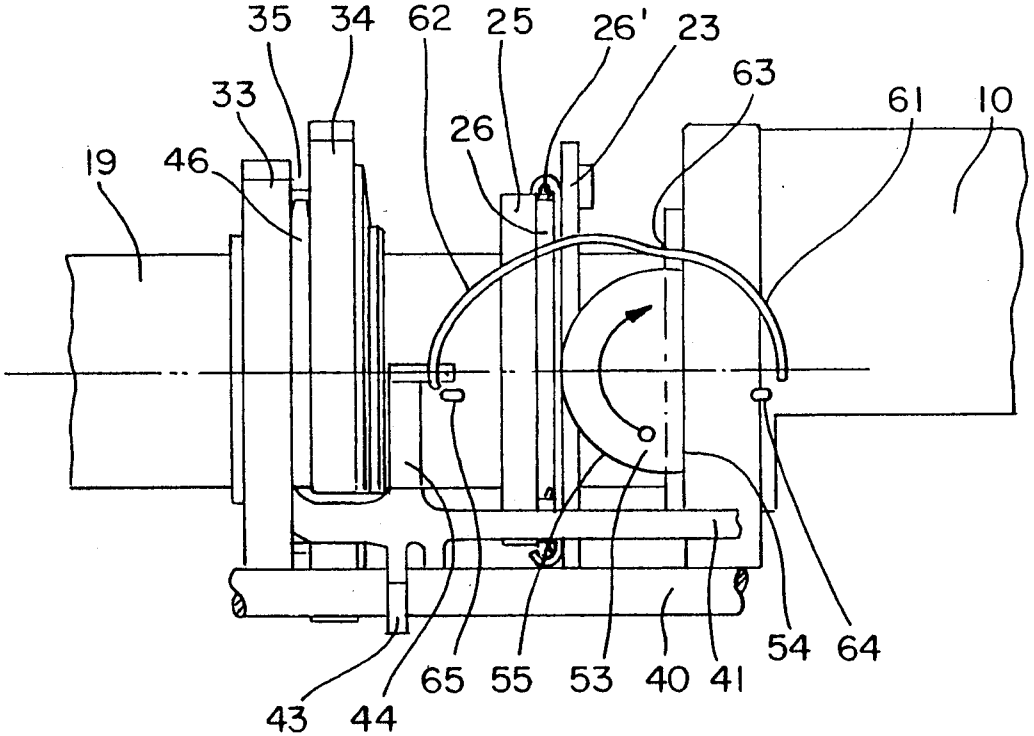
FIG. 8 shows a representation corresponding to FIGS. 6 and 7 when the adjustment handle is in the third position.

For the explanation of the function of the switching device with the stop element 53 and the cam surface 61, 62 reference is made to the diagrammatic drawings in FIGS. 6 to 8, in which parts from FIG. 2 have been omitted or are shown in a simplified form.

In the setting in FIG. 6 the adjustment handle 56, 57 is shown in its first position, in which the flat peripheral surface 54 of the stop means 53 faces towards the tool holder 7 and in which the slot 45 in the guide arm 44 of the adjustment element 41 engages with the free or first end of the first, circular portion 61 of the cam surface 61, 62, and therefore is adjacent to the stop 64. In this position the bush 36 is shifted to the right compared with the position in FIG. 2, so that the gear wheel 34 attached to the bush 36 meshes with the gear wheel section 27 on the intermediate shaft 11, and the gear assembly is therefore in the first gear position. The peripheral surface 54 of the stop means 53 lies relatively far from the sliding element 23 of the spindle 19 when the inserted tool bit 8 is not in engagement with a work piece. Thus the spindle 19 can be shifted in the known manner from its position shown in FIG. 2 to the right as a result of the bearing pressure on the work piece, until a cage 26' of the bearing 26 between the sliding element 23 and the disk 25 comes to rest against the flat peripheral surface 54 of the stop means 53 or the two coupling halves 21 and 22 are engaged such that the wobble plate element 15, 16 moves due to the continuous rotation of the intermediate shaft 11 and thus the hammer mechanism is activated. The rotary hammer then operates at a low speed with a rotary and a hammer action.

If the adjustment handle 56, 57 is rotated by the operator around the adjustment axis 59 from the position in FIG. 6 into the second position as in FIG. 7, the first portion 61 of the cam surface 61, 62 slides through the slot 45 in the guide arm 45 of the adjustment element 41, without causing axial displacement of the adjustment element 41, since the portion 61, as mentioned above, is circular about adjustment axis 59. When the adjustment handle 56, 57 is rotated in this way the stop element 53 comes into the position also shown in FIG. 7, in which the flat peripheral surface 54 extends parallel to the longitudinal axis of the spindle 19. As a result, the now front section of the circular arc-shaped peripheral surface 55 of the stop means 53 lies against the cage 26' of the bearing 26 and thus blocks the axial displacement movement of the sliding element 23 and the disk 25 and therefore of the spindle 19. As a consequence, when the inserted tool bit 8 comes into engagement with the work piece no corresponding displacement can take place and the two halves 21 and 22 of the coupling for the hammer mechanism remain disengaged, i.e. the tool holder 7 is driven by the intermediate shaft 11 via the gear wheel section 27 and the gear wheel 34 is rotated in first gear, without any impact being applied to the inserted tool bit 8 by the hammer mechanism.

On further clockwise rotation of the adjustment handle 56, 57 from the second position as in FIG. 7 into the third position as in FIG. 8, the second portion 62 of the cam surface 61, 62 leading from the first circular, portion 61, comes into engagement with the slot 45 of the guide arm 44 of the adjustment element 41, whereby due to the shape of the second portion 62 which continually increases its distance from the adjustment axis 59, the adjustment element 41 is shifted along the guide rod 40 to the front (to the left in FIGS. 2 and 6 to 8). During this sliding movement of the adjustment element 41, the latter, due to the engagement of its carrier arm 46 in the indent 35 between the gear wheels 33 and 34 takes the bush 36 carrying these gear wheels along with it and displaces them axially along the spindle 19, until the gear wheel 33 stands in meshing engagement with the gear wheel 28 attached to the intermediate shaft 11, while the gear wheel 34 has become disengaged from the gear wheel section 27. The intermediate shaft 11 consequently drives the spindle 19 at a higher speed or in second gear.

When the adjustment handle 56, 57 is rotated in this way the second into the third portion the stop element 53 is rotated so that again a region of its circular arc-shaped peripheral surface 55 is pointed towards the tool holder 7 and consequently is engaged with the cage 26' of the bearing 26. Thus the stop element 53 blocks the axial displacement of the spindle 19 in the same way as in the position in FIG. 7 and therefore the activation of the hammer mechanism so that the inserted tool bit 8 is driven in rotation in second gear but without the hammer action.

Rotation in the clockwise direction beyond the position in FIG. 8 is prevented by the stop 65 on the free end of the second portion 62 of the cam surface 61, 62, which when such a rotation takes place comes to rest against the part of the guide arm 44 of the adjustment element 41 that forms the slot 45.

Clearly, the switching device can be switched back from the position in FIG. 8 into the position in FIG. 7 or into the position in FIG. 6 by corresponding rotation of the adjustment handle 56, 57 in the anti-clockwise direction. This rotation is limited by the stop 64.

While the above described embodiment shows a switching device which enables a rotary hammer to be switched between a combined drilling and hammer mode at low speed and a pure drilling mode at low speed and a pure drilling mode at higher speed, a switching device is shown in FIGS. 9 to 12 which operates according to the same basic principle but is modified so that when it is used in a rotary hammer a pure drilling mode at low speed, a combined drilling and hammer mode at low speed and a pure hammer mode can be set. This switching device and the rotary hammer in which it is used are in the main the same as those in FIGS. 1 to 8, and in FIGS. 9 to 12, the same parts as in FIGS. 1 to 8 are designated with the same reference numbers and corresponding parts are designated with reference numbers increased by 100. Only the differences are explained below.

The structure of the rotary hammer as shown in FIGS. 9 to 12 differs from that shown in FIGS. 1 to 8 essentially in that the gear wheel 33 of the gear assembly in the rotary hammer in FIGS. 1 to 8 is replaced by a locking disk 133, which has notches 181 on its circumference and which in a manner yet to be described cooperates with a stationary mounted locking pin 180 in the casing of the rotary hammer.

Unlike the stop means 53 in FIGS. 1 to 8, the stop means 153 of the switching device in FIGS. 9 to 12 has a circular arc shaped peripheral surface 155, which extends only over about 90°, but lies concentric to the adjustment axis 159. The stop means 153 moreover has two flat peripheral surfaces 154' and 154" standing perpendicular to each other.

The stop element 153 includes a cam surface 161, 162 which is formed as a web or flange corresponding to the cam surface 61, 62 in the embodiment shown in FIGS. 1 to 8. The cam surface has a first, circular arc-shaped portion 161 extending over about 90° and lying concentric to the adjustment axis 159, on the free end of which circular arc-shaped section a stop 164 is provided. The free end of the first portion 161 with the stop 164 lies near one end of the circular arc shaped peripheral surface 155 of the stop means 153, while the other end 163 of the section 161 lies near a diameter through the adjustment axis 159, which runs parallel to the flat peripheral wall 154' of the stop element 153, so that the portion 161 in the FIGS. 9 to 12 extends roughly over the flat peripheral surface 154'' of the stop element 153.

A second portion 162 of the cam surface joins on to the end 163 of the portion 161 of the cam surface and can be formed in the same way as the second portion 62 of the embodiment shown in FIGS. 1 to 8 and on its free end and has a stop 165.

Figure 9:
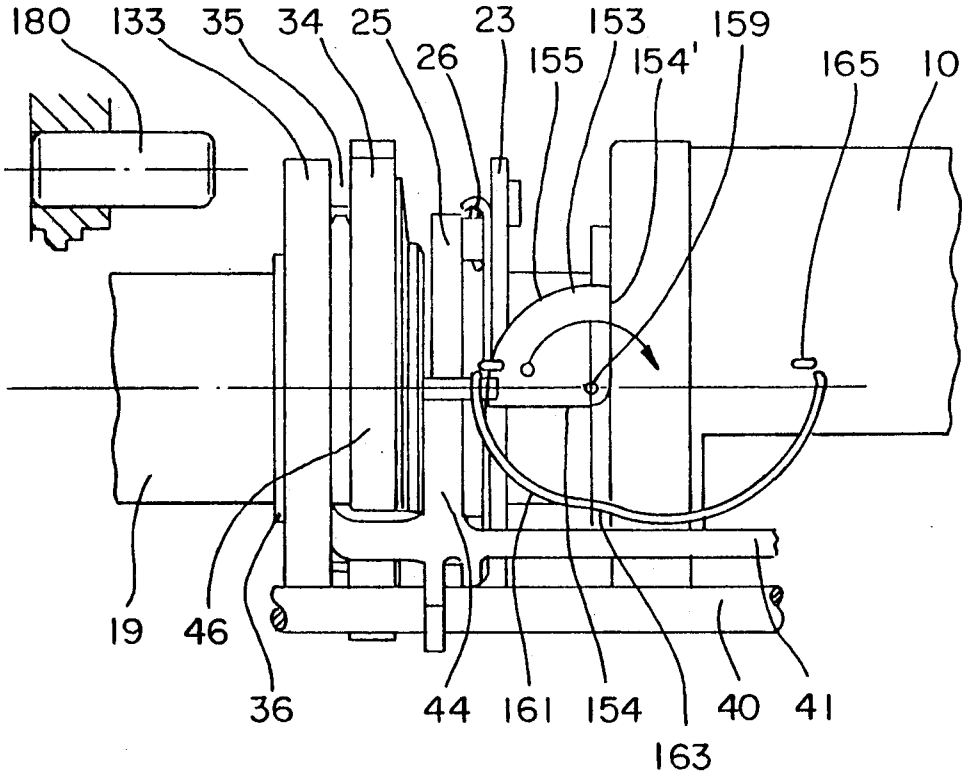
FIG. 9 shows a representation corresponding to FIGS. 6 to 8 of a switching device of different construction when the adjustment handle is in its second position.

The portion of the stop means 153 and the cam surface 161, 162 shown in FIG. 9 corresponds essentially to the second position of the adjustment handle of the embodiment as in FIGS. 1 to 8, i.e. the position in FIG. 7, because the stop means 153 has its circular arc-shaped peripheral surface 155 engaged with the cage of the bearing 26, and consequently blocks the axial displacement of the spindle 19 under the applied pressure of the inserted tool bit 8 against the work piece. As a result the activation of the hammer mechanism is prevented. Since in this position the free or second end of the portion 161 of the cam surface 161, 162 is engaged with the slot formed on the guide arm 44 of the adjustment element 41, the bush 36 mounted non-rotatably on the spindle 19 is held in a position in which the gear wheel 34 is in meshing engagement with the gear wheel section 27 of the intermediate shaft 11 not shown in FIGS. 9 to 12. As a result, when in operation, the spindle 19 and therefore the inserted tool bit 8 is rotated at a speed determined by the transmission ratio of the gear wheel section 27 and gear wheel 34, while no hammer action is applied on the inserted tool bit 8 due to the blocking effected by the stop element 153.

If the adjustment handle is rotated by 90° in the clockwise direction about the adjustment axis 159 (FIG. 10) then the position of the adjustment element 41 does not change, because the slot in guide arm 44 is still engaged with the first circular arc-shaped section 161 of the guide curve 161, 162. During this rotational movement the stop element 153 is brought into a position in which the flat peripheral surface 154'' faces towards the tool holder 7, so that when the; inserted tool bit 8 is pressed against the work piece an axial displacement of the spindle 19 takes place (to the right in FIG. 10), so that the sliding element 23, the bearing 26 and the disk 25 are also correspondingly displaced and thus the coupling halves sitting on the intermediate shaft 11 are brought into engagement. As a result the hammer mechanism is activated. This position, which corresponds in its manner of function with the position in FIG. 6, therefore enables a rotational drive of the inserted tool bit 8 at a speed determined by the transmission ratio of gear wheel section 27 and gear wheel 34 and the application of hammer action to the inserted tool bit 8.

A further rotation of the adjustment handle in the clockwise direction moves the inner, or first, end of the portion 161 of the cam surface 161, 162 out of engagement with the slot in the guide arm 44 of the adjustment element 41 and brings the free end of the second portion 162 into engagement with this slot. Due to the increasing distance of the second portion 162 from the adjustment axis 159 a shifting of the adjustment element 41 to the left then takes place, as was explained in connection with FIG. 8. As a result the gear wheel 34 comes out of engagement with the gear wheel section 27 of the intermediate shaft 11 and the disk shaped gear part or locking disk 133 sitting non-rotatably on the bush 36 is pushed into the area of the stationary locking pin 180, so that the latter extends into one of the notches 181 formed on the circumference of the gear part 133. In this position, consequently, there is no rotational drive acting on the spindle 19 and the spindle 19 is in addition secured against rotation by the engagement of the locking pin 180 in thenotch 181 of the gear part 133.

Figure 10:
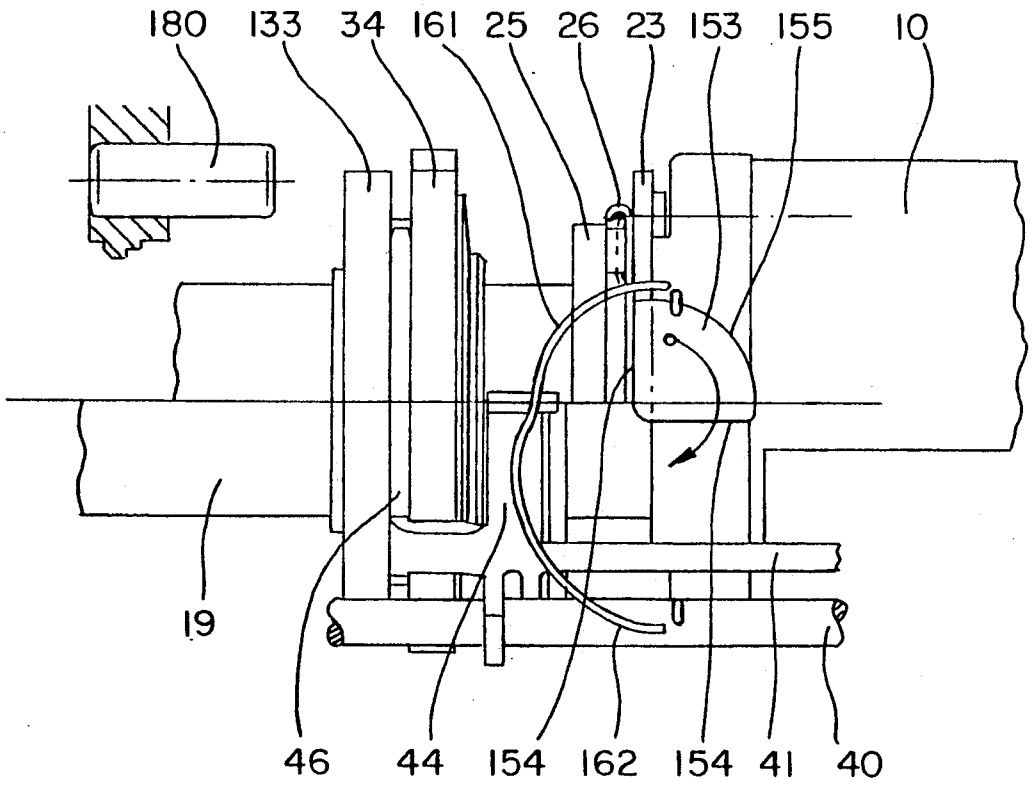
FIG. 10 shows the switching device of FIG. 9 when the adjustment handle is in its first position.
Figure 11:
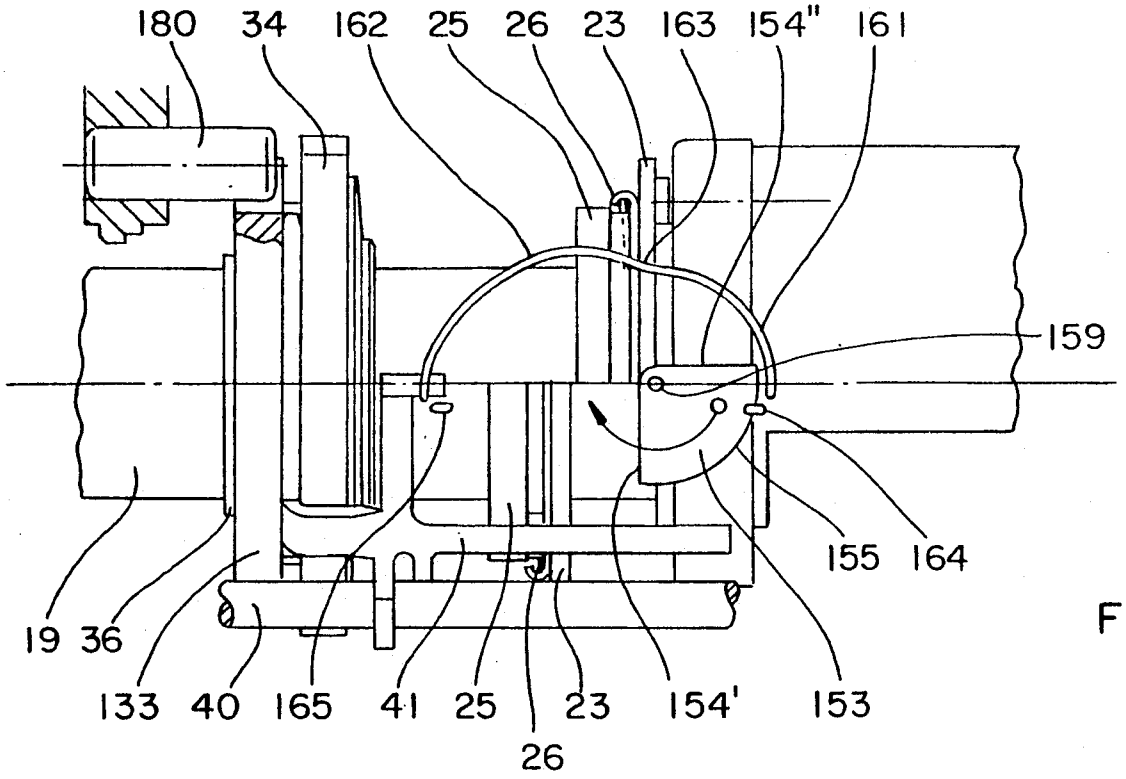
FIG. 11 shows the switching device of FIGS. 9 and 10 when the adjustment handle is in its third position.
Figure 12:
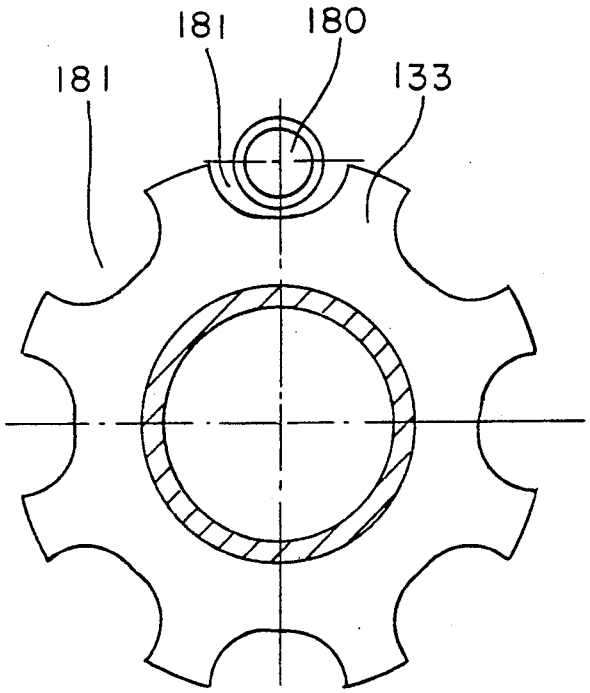
FIG. 12 shows in part section engagement of a locking pin with the gear assembly in the third position of the adjustment handle as shown in FIG. 11.

When the cam surface 161, 162 is displaced into the position as in FIG. 11 the stop means is rotated into a position in which the flat peripheral surface 154' is facing the tool holder 7, i.e. the spindle 19 can be axially displaced in the same way as in the position shown in FIG. 10 when the inserted tool bit is pressed against the work piece and thus the hammer mechanism can be activated. The rotary hammer therefore operates in pure hammer mode, that is without rotation of the spindle 19 and therefore of the tool holder 7 and the inserted tool bit 8.

I claim:

1. A power tool adapted to hold a tool bit which can be operated with a rotating action and a hammer action comprising drive means for causing the tool bit to rotate including a gear assembly which can be switched between a low gear drive and a high gear drive, hammer means for imparting a hammer action to the tool bit and activated by axial displacement of the tool bit on engagement of said bit with a work piece, an adjustment handle connected to stop means and rotatable about an adjustment axis between a first position in which the stop means allow axial displacement of the tool bit to activate the hammer means and a second position in which the stop means blocks axial displacement of the tool bit, a cam member coupled to the adjustment handle and having an arcuate cam surface, said surface comprising a first, circular portion concentric with the adjustment axis and a second portion leading from one end of the first portion and continuously changing in distance from said axis, an adjustment element engaging the cam surface movement of which is arranged to switch said gear assembly between low gear and high gear drive the arrangement being such that when the adjustment handle is in its first position the adjustment element is in engagement with one end of said first portion of the cam surface, when the adjustment handle is in its second position the adjustment element is in engagement with the other end of the first portion of the cam surface, with no movement of the adjustment element taking place as the adjustment handle is moved between its first and its second positions, and the adjustment handle is movable into a third position beyond one of its first and second positions so that the adjustment element is in engagement with the second portion of the cam surface and the adjustment element is displaced to cause the gear assembly to change between a low gear and a high gear drive.

2. A power tool according to claim 1 wherein the second portion of the cam surface leads from said one end of the first portion and is continuously increasing in distance from said adjustment axis.

3. A power tool according to claim 1 wherein the adjustment element is in positive engagement with the cam surface.

4. A power tool according to claim 3 wherein the cam surface is provided by a curved web and the adjustment element comprises a slot having side walls which engage opposite surfaces of the web.

5. A power tool according to claim 1 wherein stops are provided adjacent the ends of the cam surface which limit rotational movement of the cam member.

6. A power tool according to claim 1 wherein the stop means comprises an arc shaped stop surface circular about the adjustment axis.

7. A power tool according to claim 1 wherein the gear assembly is axially displaceable and the adjustment element moves the gear assembly axially to switch between a low gear drive and a high gear drive.

8. A power tool according to claim 7 wherein the adjustment element is mounted for movement on a guide rod which extends parallel to a central axis of the gear assembly.

9. A power tool according to claim 1 wherein the second portion of the cam surface continues from that end of the first portion of the cam surface associated with the second position of the adjustment handle, and movement of the adjustment handle into the third position from the second position causes the adjustment element to switch the gear assembly from a low gear drive to a high gear drive.

10. A power tool according to claim 9 wherein the stop means, when the adjustment handle is in its third position, blocks axial displacement of the tool bit.

* * * * *